US007236130B2

(12) United States Patent
Voigtlaender

(10) Patent No.: US 7,236,130 B2
(45) Date of Patent: Jun. 26, 2007

(54) SYMMETRICAL ANTENNA IN LAYER CONSTRUCTION METHOD

(75) Inventor: Klaus Voigtlaender, Wangen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/992,192

(22) Filed: Nov. 17, 2004

(65) Prior Publication Data

US 2005/0104795 A1 May 19, 2005

(30) Foreign Application Priority Data

Nov. 17, 2003 (DE) ..... 103 53 686

(51) Int. Cl.
*H01Q 1/38* (2006.01)
*H01Q 9/16* (2006.01)

(52) U.S. Cl. ..... 343/700 MS; 343/713; 343/793; 343/815

(58) Field of Classification Search ..... 343/792, 343/841, 700 MS
See application file for complete search history.

(56) References Cited

U.S. PATENT DOCUMENTS 4,162,499 A * 7/1979 Jones et al. ..... 343/700 MS
4,682,180 A * 7/1987 Gans ..... 343/769
5,418,544 A * 5/1995 Elliot ..... 343/797
5,497,164 A * 3/1996 Croq ..... 343/700 MS
5,917,458 A * 6/1999 Ho et al. ..... 343/909
6,281,843 B1 * 8/2001 Evtioushkine et al. ..... 343/700 MS
6,320,547 B1 * 11/2001 Fathy et al. ..... 343/700 MS
6,384,785 B1 * 5/2002 Kamogawa et al. . 343/700 MS
7,012,569 B2 * 3/2006 Gottwald et al. .... 343/700 MS
2004/0113840 A1 * 6/2004 Gottwald et al. .... 343/700 MS

FOREIGN PATENT DOCUMENTS

DE 100 63 437 11/2002

* cited by examiner

*Primary Examiner*—Trinh Vo Dinh
(74) *Attorney, Agent, or Firm*—Kenyon & Kenyon LLP

(57) ABSTRACT

An antenna array, especially for spacing ascertainment or speed ascertainment in the surroundings of motor vehicles, includes devices for transmitting and/or receiving signal waves, which includes a shielding layer construction, made up of at least two layers, which includes the transmitting or receiving devices at least in part. To achieve above all a good immunity to interference, the antenna array includes a differential input buried in a dielectric layer and it includes a transmitting and/or receiving dipole, which is composed of two separate dipole halves.

12 Claims, 13 Drawing Sheets

SYMMETRICAL ANTENNA IN LAYER CONSTRUCTION METHOD

FIELD OF THE INVENTION

The present invention relates to an antenna array and especially to an antenna array made by a layer construction method for ascertaining vehicle spacing or speed in the surroundings of motor vehicles.

BACKGROUND INFORMATION

There are systems in which the distance and the speeds are measured by radar (microwaves), especially short-range radar. In this context, above all, small antenna arrays in compact layer building method are used. In the antenna arrays in this field having microstrip feeding, coplanar feeding or slot coupling, asymmetrical excitation is always or generally involved. In asymmetrical excitation, the signal lines (feed lines and return lines) are not developed in the same way, as in symmetrical excitation, but rather, the signal is on the feed line and the "return line" is at ground, and is usually developed as a metallic plane. In asymmetrical excitation, what may be particularly disadvantageous is the susceptibility to failure by spurious radiation from outside, which corrupts the signal.

In a large-scale integration of circuit components, because of its immunity to interference, differential, i.e. symmetrical inputs and outputs may be used. In order to be able to carry out asymmetrical feeding, in this context, costly impedance-matching sections or external baluns (balance) have to be employed. An additional disadvantage of asymmetrical excitation is radiation losses in response to a patch coupling because of the required field vector rotation of the electrical field. By patches, one is given to understand metallic radiation-emissive surfaces which are mostly rectangular.

An example of an antenna array, constructed of several layers, having asymmetrical excitation, is referred to in German patent document no. 100 63 437, in which there are two potential surfaces at ground, the so-called earth planes, each outside and parallel to the plane of stratification. Close to below the earth plane, facing the transmitting direction, which has a coupling slot, an electrical connecting section is situated. The radiation exiting from the coupling slot couples into a patch lying above it. In this context, the patch is the transmitting and/or receiving device. It is true that, in response to this screening arrangement, to a certain extent, spurious radiation from outside is deterred and radiation of the useful radiation in undesired directions is delimited, but the disadvantages caused by the asymmetrical excitation are still not satisfactorily removed.

SUMMARY OF THE INVENTION

Using the measures described herein, an antenna array that is easy to manufacture in a layer construction method is made available, particularly for ascertaining distance apart and speed in the surroundings of motor vehicles, which has an improved immunity to interference. Besides the arrangements for transmitting and/or receiving, the antenna array includes layers of dielectric material. Conductive metal is used for shielding. In the differential input according to the exemplary embodiment of the present invention, two signal feeds running in parallel connect two separate dipole halves. The signals in the two lines are in phase opposition. Thereby, in the lines running parallel, an undesired radiation is delimited by a quenching signal addition. On the other hand, the signals supplement one another at the signal output, when they are subtracted from one another. However, spurious radiation from outside appears on both signal feeds in phase, so that it is eliminated by a subtraction.

Furthermore, because of the differential input of the antenna array according to the present invention, when using differential inputs and outputs for a large-scale integration of circuit components, the costly impedance-matching section or external baluns are unnecessary.

One exemplary embodiment is an integration of the two signal feeds of the input into the layer construction, which achieves a compact system, such as by microstrip feeding.

Another exemplary embodiment includes a dipole-patch coupling with a patch at a predetermined distance from the dipole. A relatively high bandwidth is achieved by a choice of geometry having two offset resonance frequencies. An especially good coupling comes about using a distance in the range of 0.01 to 0.2 times the wavelength of the radiation.

According to another exemplary embodiment, dipole and patch are positioned in parallel, and the dipole to the feed lines is oriented in such a way that the vector(s) of the electrical field lie in parallel in patch and dipole, and have the same direction. A field vector rotation and radiation losses connected therewith do not appear.

According to still another exemplary embodiment of the antenna array according to the present invention, the two signal feeds are a parallel system of two printed or etched lines, and in the layer construction, two symmetrically arranged dipole halves are provided in a subdivision (into smaller chambers), which are conductingly connected with one feed line each. In a layer construction, etched or printed lines are simple and well suited feedings. The common subdivision of the symmetrically situated dipole halves spatially limits the radiation and thereby improves the radiation characteristics.

According to another exemplary embodiment, the signal lines are buried in a di-electrical layer of the layer construction, so that the signal lines do not run along the surface, but in a lower layer. Thereby, according to the exemplary embodiment of the present invention, crossings of lines in a supply network are easy to achieve in the case of the interconnection of several antenna elements, without bonds or air bridges, in that a line is moved on a small scale in another plane of stratification.

Another exemplary embodiment of the present invention, in the form of the embodiment having buried signal lines, is an external earth plane that faces the transmission direction and is situated parallel to the dielectrical layer, which, as seen from opposite to the transmission direction, is located before the signal lines. Thereby, the signal lines in transmission direction lie behind a screening earth plane, which has the effect of decoupling between feeding and radiated radiation.

Yet another exemplary embodiment, with supply lines buried, includes a connection in the middle of the inner edge of the respective dipole halves using through-hole plating.

According to another exemplary development, the dipole is surrounded by a ground bordering that shields perpendicular to the layer between the two outer sides that exist parallel to the layering. Thereby shielding perpendicular to the plane of stratification is achieved, thus at the edge, for instance, on the right and left in FIG. 8. The ground bordering is made of "chamber strips" of a conducting material, and is interrupted at the place of breakthrough of the signal lines. The ground bordering at the edge may also be made up of contact lines connecting the outside ground planes that lie close to one another, so-called through-hole plating or vias. Of particular advantage is a distance of such a ground bordering from the dipole of a quarter of the wavelength. "Vagabonding" radiation energy is reflected back and is supplied phase-corrected to the radiation.

According to another exemplary embodiment, the dipole and/or the patch are on both sides, in a wedge-shaped manner, pointed towards the middle, in a planar manner. The bandwidth is increased by this biconical planar shape.

According to another exemplary embodiment, the distance between two signal supply lines is equivalent to about one tenth to one hundredth of the wavelength of the radiated radiation, and the lines are activated in phase opposition. Thereby, there occurs an extensive extinction of the far field of the leakage radiation outgoing from the signal lines.

According to yet another exemplary embodiment, the antenna array according to the present invention includes several transmitting and/or receiving devices that are positioned at a predetermined distance from one another. These, for example, form a series or a field. Because of that, the directivity characteristic and the gain of the radiation are further improved. It is especially advantageous to have an arrangement of the sending and/or the receiving directions in series, similar to a Bruce Array. By this arrangement of the neighboring transmitting and/or receiving devices at a distance of about one-half of a wavelength, one achieves an especially good supplementation of the emission in the provided radiation direction.

Although able to be used in any field of application in the antenna sector, the exemplary embodiment of the present invention and the problem on which it is based are explained with reference to an antenna array on board a motor vehicle to ascertain vehicle spacing or speed, in the surroundings of motor vehicles.

DETAILED DESCRIPTION

In the figures, the same reference numbers designate the same or functionally equivalent components. All the drawings are schematic, and, for the purpose of increased clarity of the topology of each respective layer configuration, the illustrations are not to scale.

Figure 1:
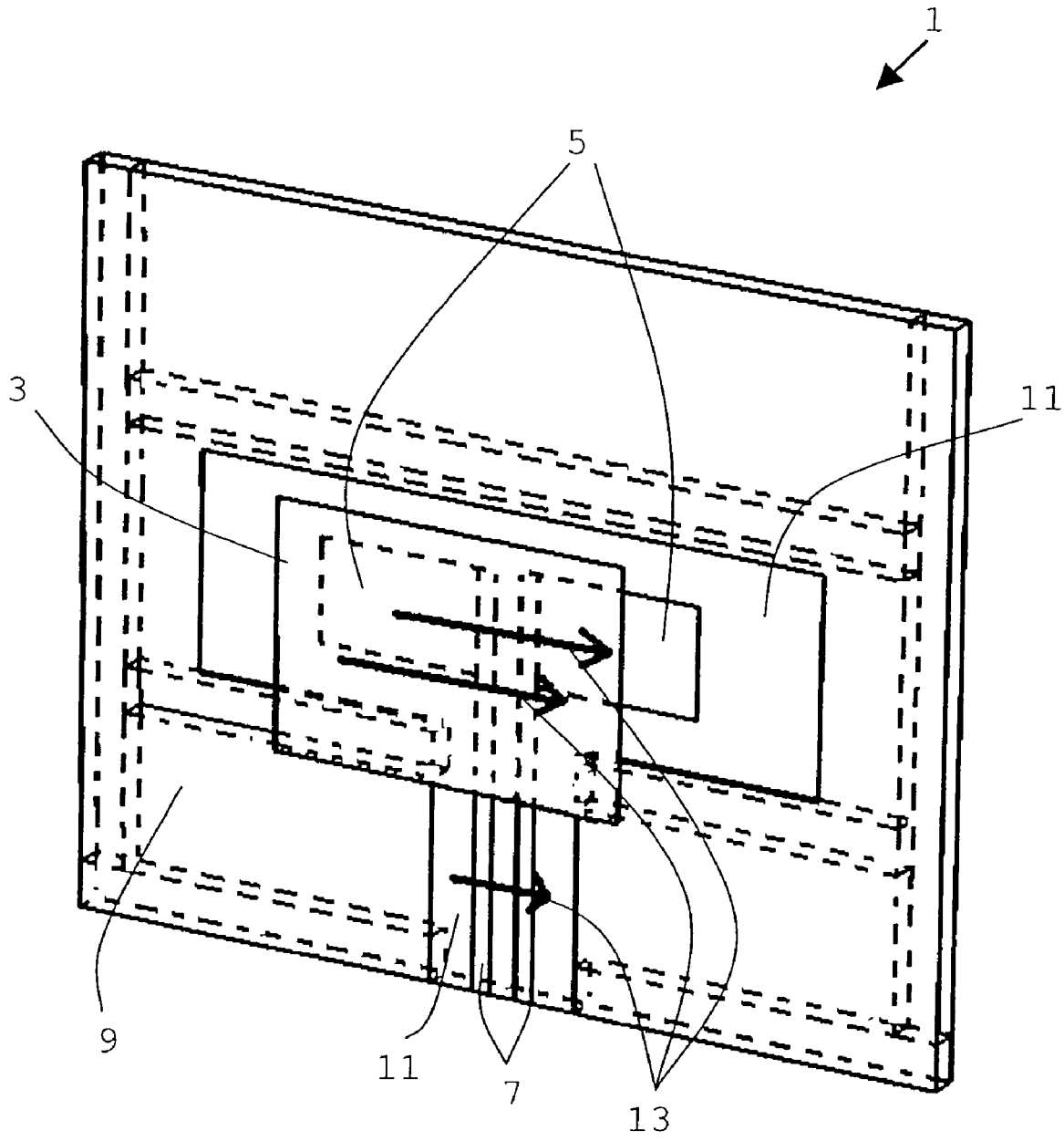
FIG. 1 shows a schematic view of an antenna array showing the field vectors of the electrical fields, according to a first exemplary embodiment of the present invention.

FIG. 1 shows a schematic view of an example of antenna array 1 according to the present invention, having a representation of field vectors 13 of the electrical fields. Patch 3, a rectangular sheet metal platelet, is situated parallel to the stratification of antenna array 1, at a distance of approximately the 0.1-fold of the wavelength of the transmitted radiation via flat dipole 5 on the stratification system, that is about 1.2 mm, at 24 GHz.

The distance is not limited to this measure, but rather, it may vary. A range of from 0.01 to 0.2 of the wavelength is very suitable. The transmitted radiation has a frequency in a range about 26 GHz. Because of the dielectric load and coupling with dipole 5, patch 3 is a little shorter than the air wavelength, but measures approximately one-half of the wavelength of the transmitted radiation.

In this context, one takes into account reductions in wavelength because of end effects and slenderness factors. Patch 3, for example, is fastened to the unit housing (not shown) free above dipole 5, or, using a foam layer, on dipole 5. According to the exemplary embodiment of the present invention, dipole 5 is made up of two separate rectangular metal areas which are applied onto a dielectric substrate 11, such as a printed-circuit board, a ceramic or a soft board material. The dipole halves each have a length of approximately one-quarter of a wavelength. In this context, the wavelength is not assessed in air, but effectively loaded by the dielectric substance.

According to the exemplary embodiment of the present invention, each individual dipole half is fed using a signal supply line 7. The two signal supply lines 7 are situated in parallel, and thus, according to the exemplary embodiment of the present invention, they form a differential input. They run on the surface of substrate layer 11, and are, for instance, printed or etched. On substrate layer 11 there has also been applied a metallic earth plane 9 screening off the radiation, which has recesses only in the area of signal supply lines 7 and of dipole 5. In addition, there is a straight-through, screening off, metallic earth plane on the not visible back side of antenna array 1.

Dipole 5 and patch 3 are situated parallel to each other, and the two signal supply lines 7 run perpendicular thereto. With that, field vectors 13 of the electrical field of dipole 5, of patch 3 and of supply lines 7 lie parallel to one another, and point in the same direction.

Figure 2:
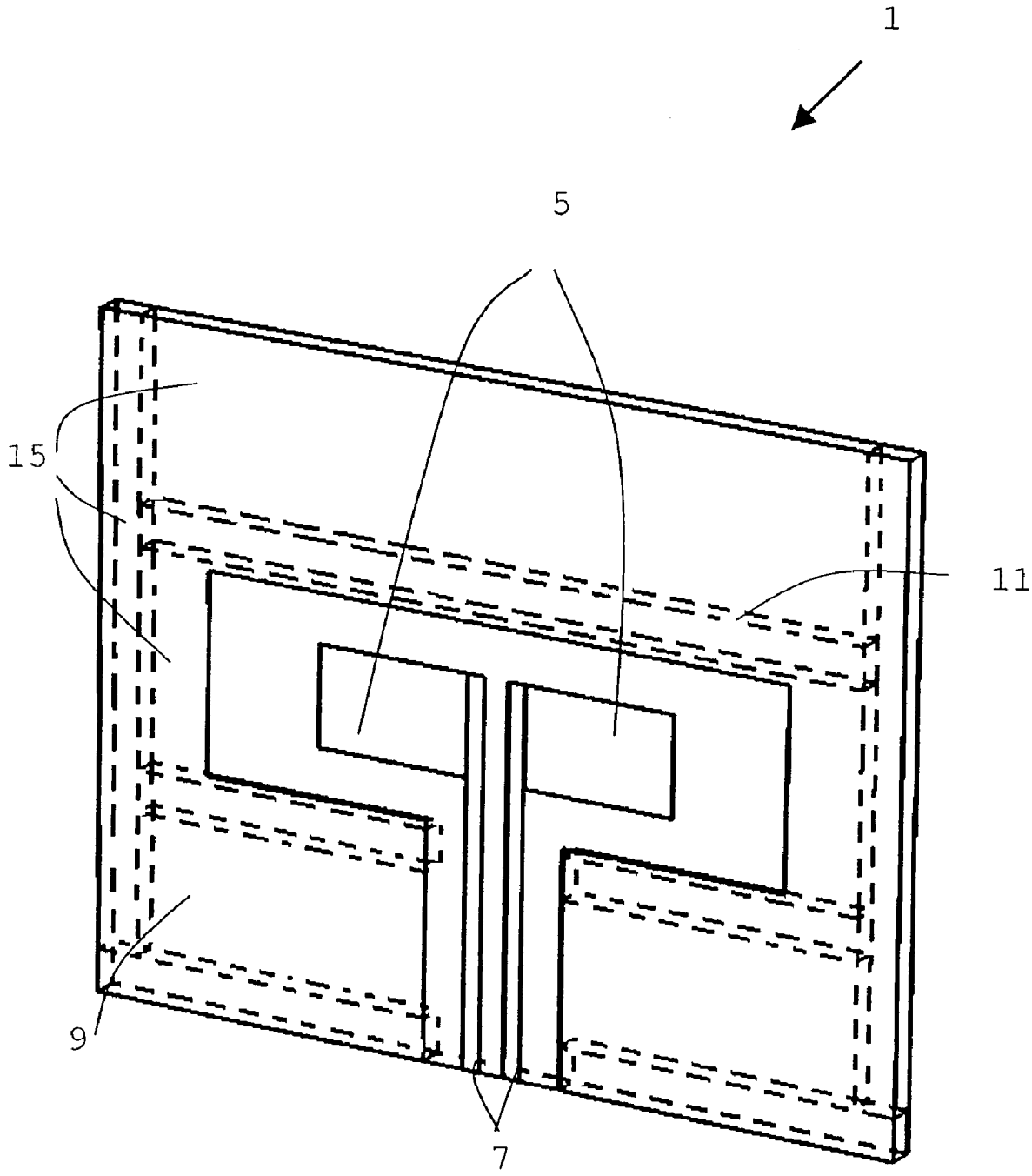
FIG. 2 shows a schematic view of an antenna array beginning at the plane of stratification, under the patch, according to the first exemplary embodiment.

FIG. 2 shows schematically the view of an example of antenna array 1, according to the exemplary embodiment of the present invention, beginning from the plane of stratification under patch 3 in FIG. 1. The separate halves of dipole 5 on their inside edges are connected to signal supply lines 7. In the layers below earth plane 9 there are metallic chamber strips 15, shown by dashed lines, which reach all the way to the earth plane (not visible) on the back side. These chamber strips 15 conductingly connect the two outside earth planes 9 and border dipole 5 right up to a passthrough opening for signal supply lines 7. This ground shielding suppresses to the greatest extent the lateral radiation. Bordering chamber strips 15 have a distance from dipole 5 of a quarter of the wavelength of the transmitted radiation. Radiation radiated into substrate 11 is reflected at chamber strips 15 and returned phase-corrected.

Figure 3:
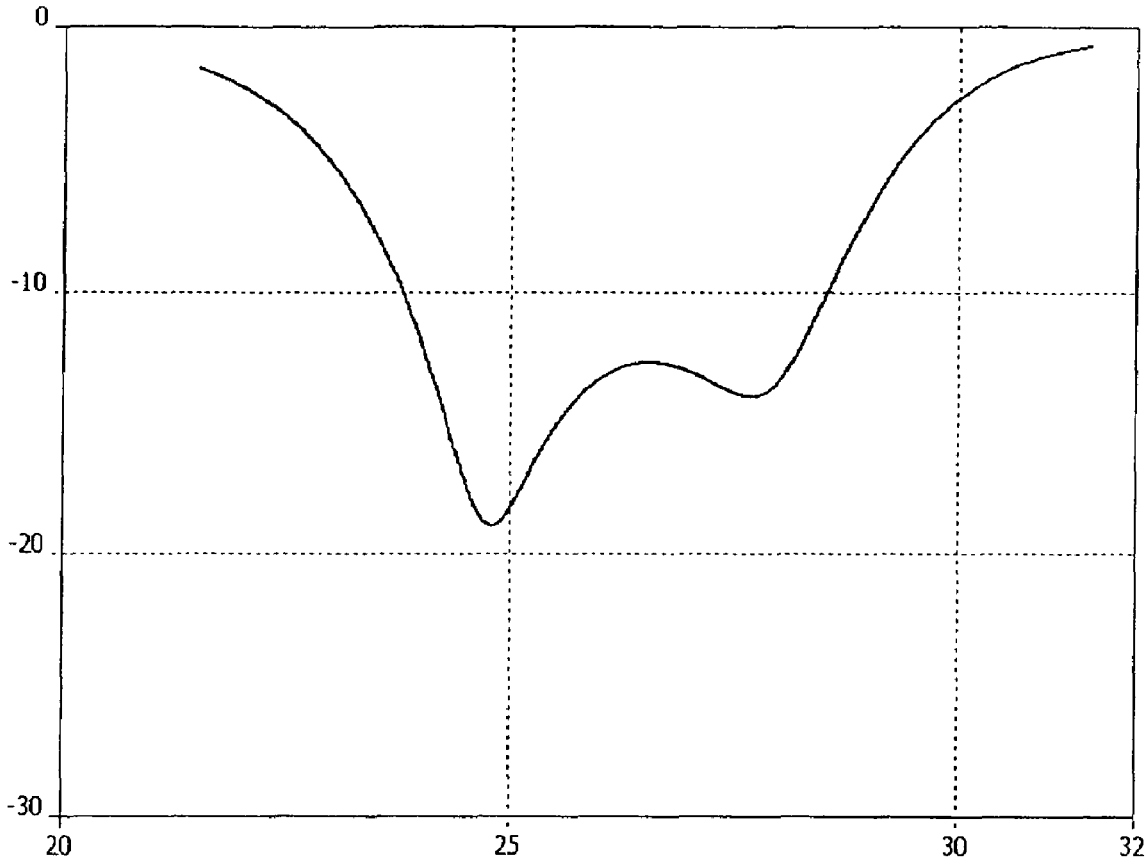
FIG. 3 shows a diagram of the calculated adjustment of an antenna array according to the first exemplary embodiment.

FIG. 3 shows a diagram of the calculated adjustment of an antenna system according to the first exemplary embodiment. In this context, as a measure for the adjustment, there is plotted the quantity, given in decibels, of the S parameter against the frequency scaled in gigahertz (GHz). The adjustment in the frequency range of 23.8 to 28.5 GHz has a value of less than −10 dB. It has two minima, which are at a distance from each other of ca 1.5 GHz. The relatively large bandwidth of the antenna of 4.7 GHz and the two resonance peaks result from the patch-dipole coupling. The large bandwidth is achieved because of a geometry choice of patch and dipole having two displaced resonant frequencies.

Figure 4:
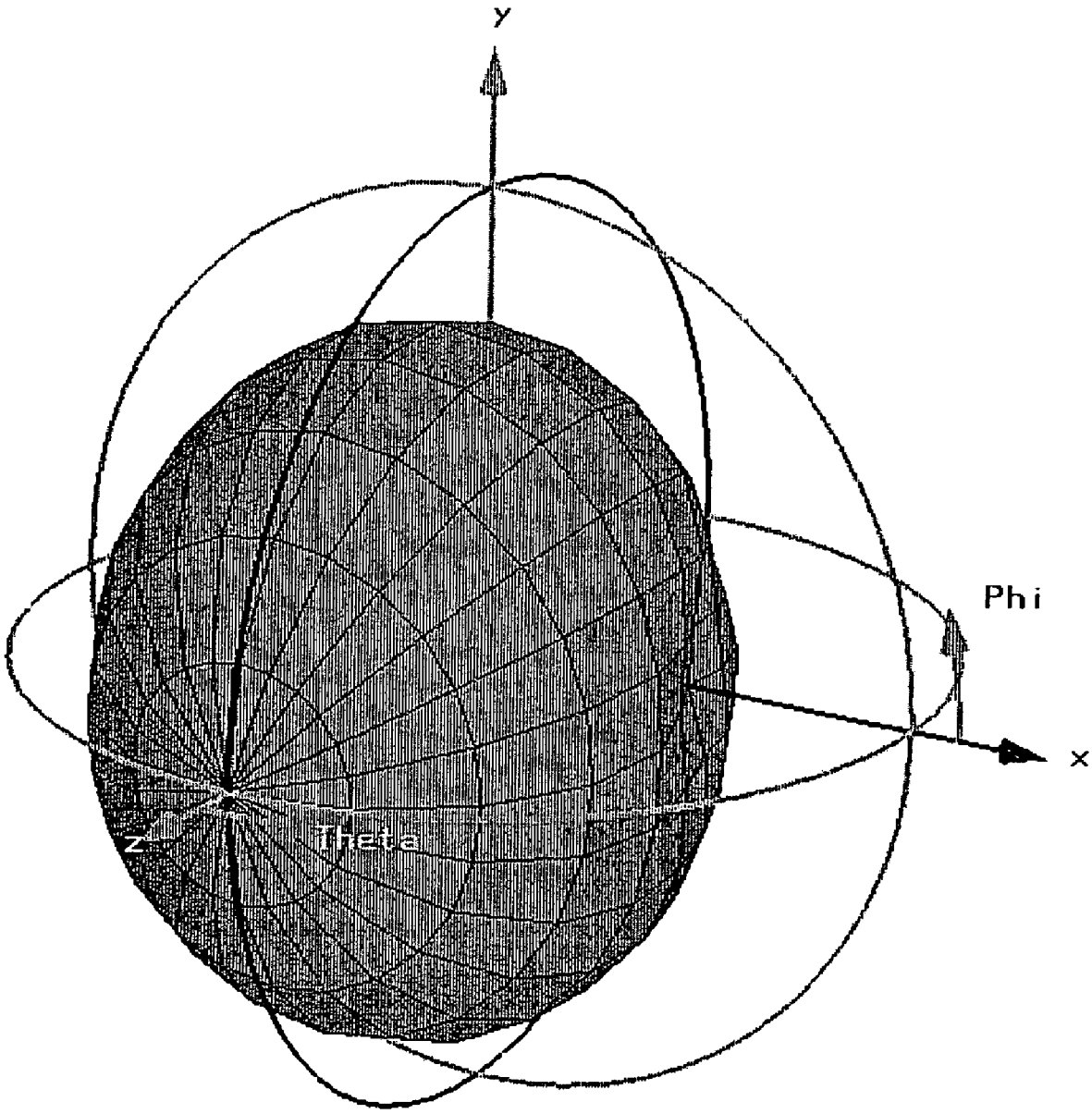
FIG. 4 shows a directional diagram of the far field of the radiation of an antenna array according to the first exemplary embodiment.

FIG. 4 shows a directional diagram of the far field of the radiation of an antenna array according to the first exemplary embodiment. The frequency of the radiation is 26 GHz. The gain in the transmission direction amounts to 8.18 dBi, as compared to a spherical source. Lateral minor lobes are not formed.

Figure 5:
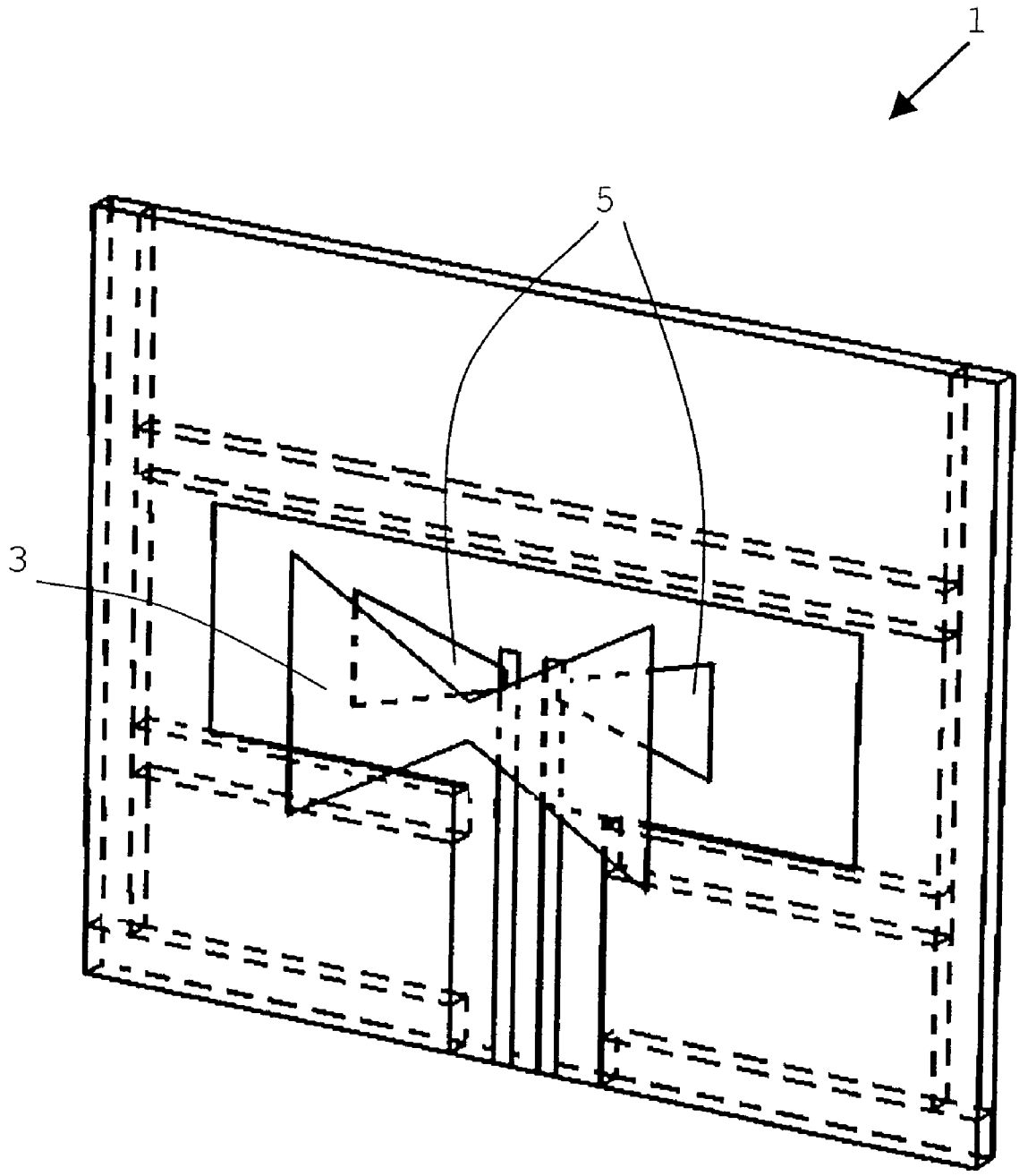
FIG. 5 shows a schematic view of an antenna array having a biconical patch and dipole according to a second exemplary embodiment of the present invention.

In FIG. 5 there is shown schematically the view of an antenna array 1 having bi-conical patch 2 and a bi-conical dipole 5, according to a second exemplary embodiment of the present invention. The bandwidth of the antenna is increased by this bi-conical shape. A combination of bi-conical/rectangular shapes may also be used.

Figure 6:
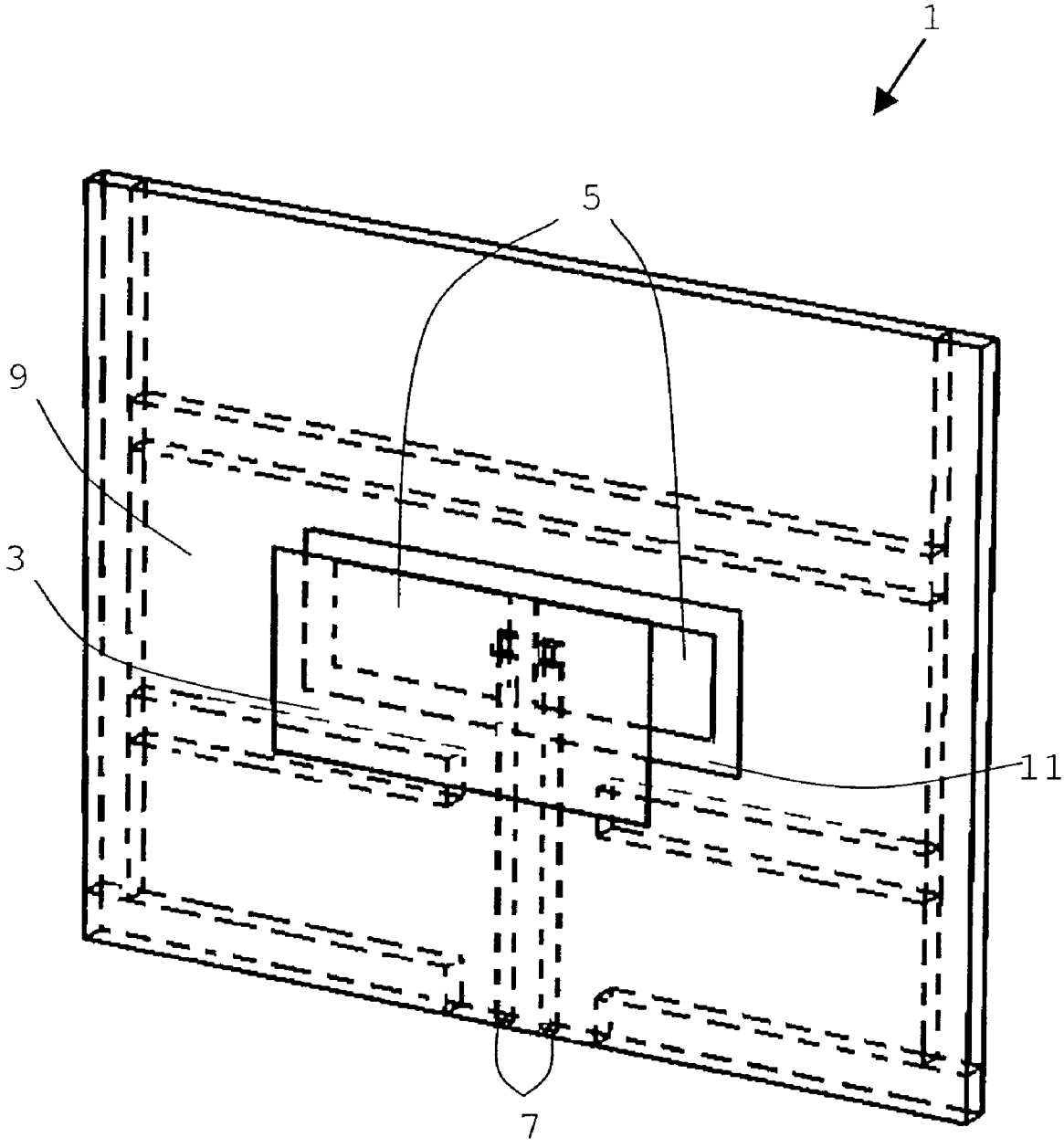
FIG. 6 shows a schematic view of an antenna array having buried signal supply lines according to a third exemplary embodiment of the present invention.

A third exemplary embodiment of antenna array 1 according to the present invention is shown in FIG. 6. As in the first exemplary embodiment shown in FIG. 1, rectangular patch 3 is situated above dipole 5 which is made up of two separate rectangular halves, which is inserted into a dielectric substrate layer 11. Because supply lines 7 are located in an inner layer, earth plane 9 is not interrupted at the surface in the area of signal supply lines 7. A recess in upper earth plane 9 exists only in the area of dipole 5. There is a complete ground shielding of dipole 5. Feeding and radiation are decoupled.

Figure 7:
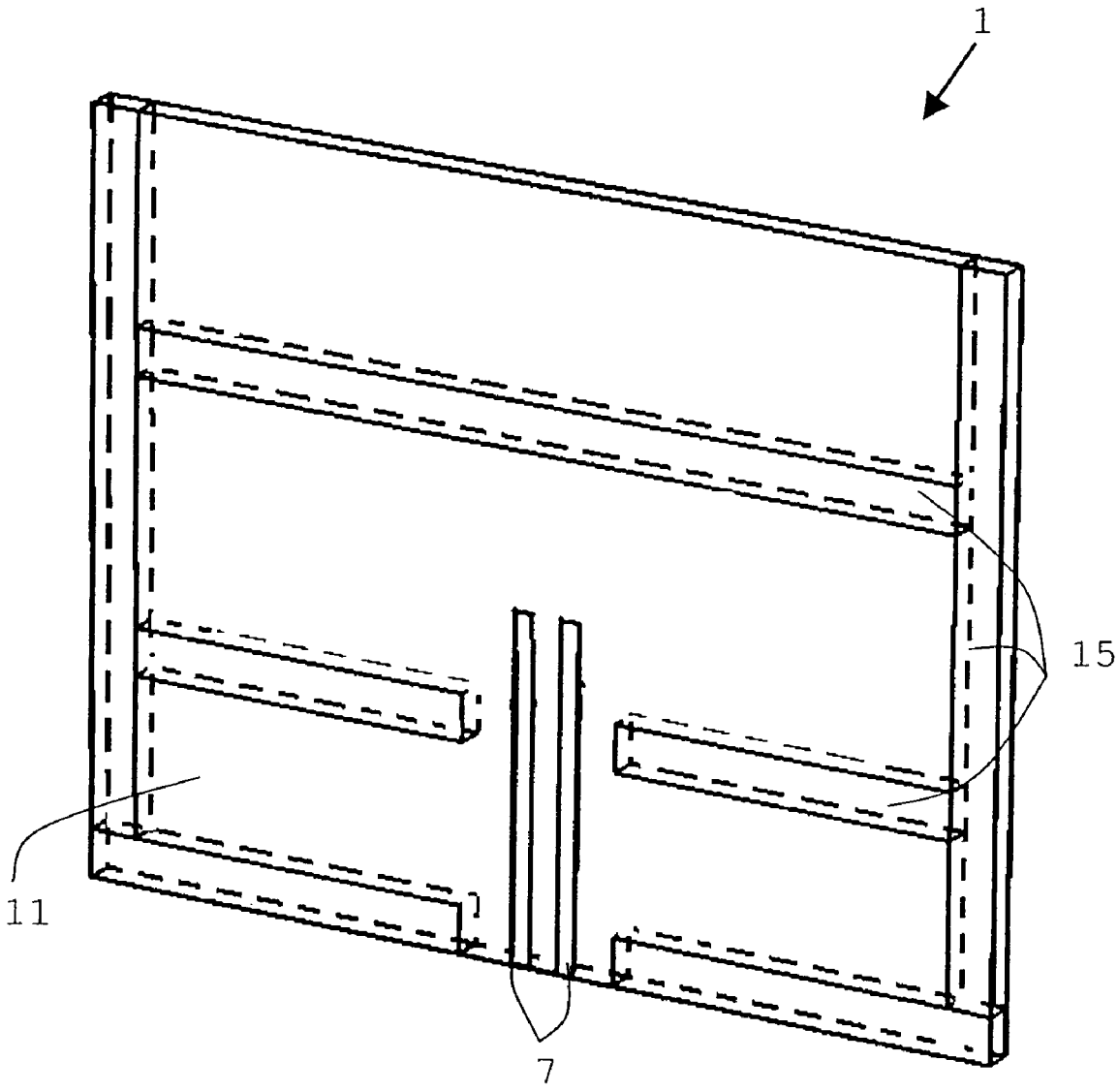
FIG. 7 shows a schematic view of the plane of stratification of the buried signal supply lines of an antenna array according to the third exemplary embodiment.

The two parallel running signal supply lines 7 may be recognized also in FIG. 7. In this schematic view of antenna array 1, the plane of stratification is shown in which signal supply lines 7 are located. What is not shown is the substrate layer lying above it, which serves as insulation between the upper earth plane and signal supply lines 7. Signal supply lines 7 lie in a substrate layer 11 and are connected in the z direction to the respective halves of the dipoles (not shown here) that lie above that layer. Chamber strips 15 running through the various substrate layers 11 (see FIG. 8) form a lateral ground shielding of the dipole at a distance of ca one-quarter of a wavelength.

Figure 8:
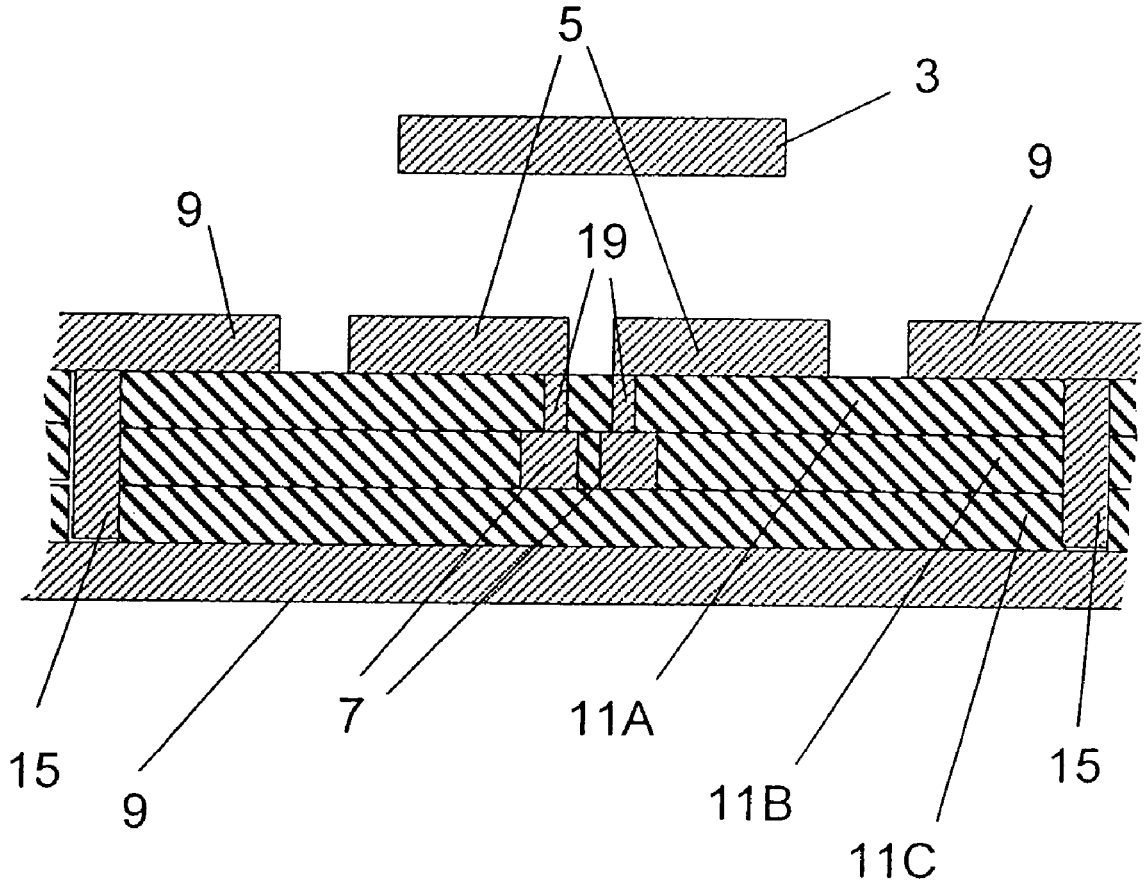
FIG. 8 shows a cross-sectional view of an antenna array according to the third exemplary embodiment.

The entire layer construction is shown in FIG. 8, in a cross sectional view of antenna array 1, according to the exemplary embodiment of the present invention, and is to be understood as being only schematic (not according to scale, layers partially higher than actual in relation to one another). Metal is hatched going upwards (from left to right), dielectrics are hatched dropping off downwards and air gaps correspond to white areas that have been left blank.

Patch 3 is applied over the layers that are firmly connected to one another. The two dipole halves 5 are located to the right and the left of the middle of the uppermost layer, and enclose a central air gap. On the outside, too, there follows in each case an air gap that separates dipoles 5 from upper ground covering 9.

Lying below this, there follows a first substrate layer 11A which is interrupted by through-hole contacting 19 (vias), which lead to signal supply lines 7, which are situated in a still deeper following substrate layer 11B. Signal supply lines 7 are formed as relatively thin, lineal layer structure, in comparison to substrate layer thickness. Thus, the two signal supply lines 7 are in electrical contact with the halves of dipole 5 lying above with the aid of through-hole plating 19.

After an additional insulating substrate layer 11C, the layer construction closes towards the bottom with an additional metallic grounding bar 9. The two outside grounding bars 9 are connected conductingly to each other by metallic chamber strips 15 that run through substrate layers 11. The entire ground shielding 9, 15 forms a subdivision of dipole 5. It should still be added that all metal structures are shown quite in excess in their thickness (layer thickness). The metal layers may have a thickness of ca 1% to ca 20% of the thickness of the substrate layers.

The structure shown in FIG. 8 may be imagined now to be elongated to the right and to the left, the antenna elements 5 (dipole), 7 (supply line) and 19 (via) being then repeatedly situated at predefined lateral separation distances. Metallic connections 15, as a part of the above-mentioned subdivision, may be first applied in the form of holes into substrate 11, such as by stamping, and are later in the manufacturing process filled using metal.

Figure 9:
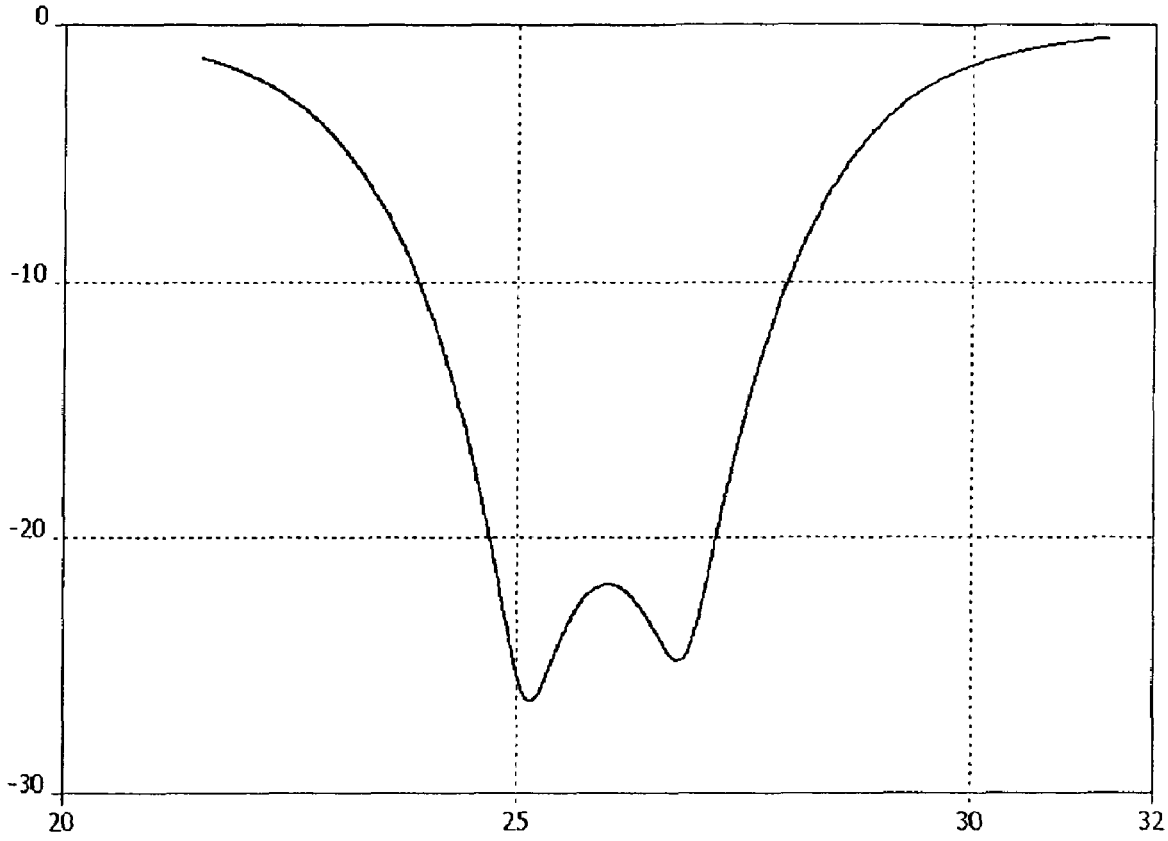
FIG. 9 shows a diagram of the calculated adjustment of an antenna array according to the third exemplary embodiment.
Figure 10:
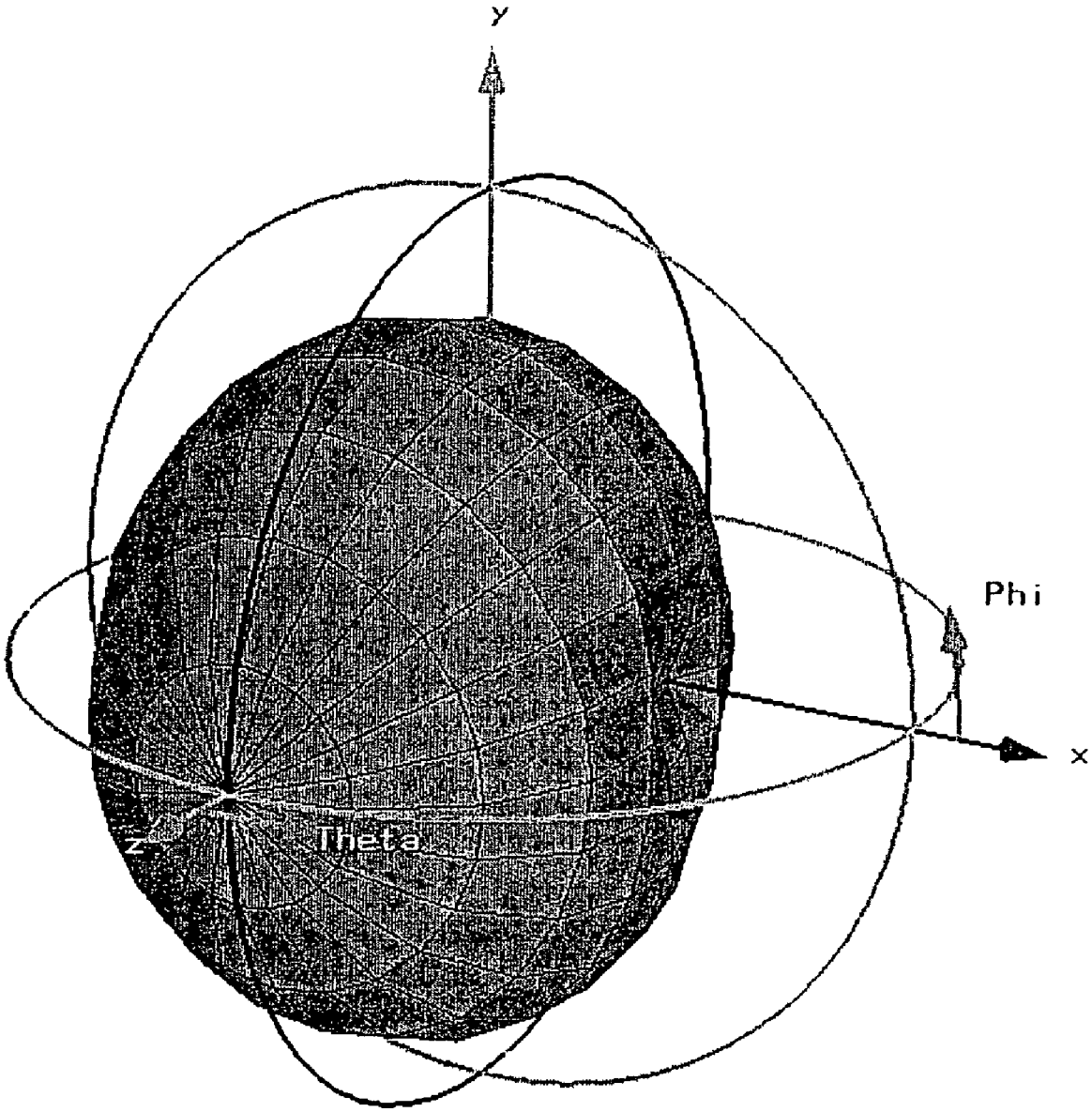
FIG. 10 shows a directional diagram as representation of the directivity characteristic of the far field of the radiation of an antenna array according to the third exemplary embodiment.

FIG. 9 shows a diagram of the calculated adjustment of an antenna array according to the third exemplary embodiment. In this context, as a measure for the adjustment, there is plotted the quantity, scaled in decibels, of the S parameter against the frequency given in gigahertz (GHz). The adjustment in the frequency range of 24 to 28 GHz has a value of less than −20 dB. Thus, the antenna has a bandwidth of 4 GHz. The adjustment curve has two clear resonance minima which are a distance of ca 1.5 GHz apart. The large bandwidth of the antenna having the two resonant peaks comes about because of the patch-dipole coupling. Because of the decoupling of feeding line and patch, an improvement of the adjustment and symmetry is achieved at 26 GHz. In the appertaining directional diagram in FIG. 10 one may recognize a gain of 8.3 dBi at simultaneous good minor lobe suppression.

Figure 11:
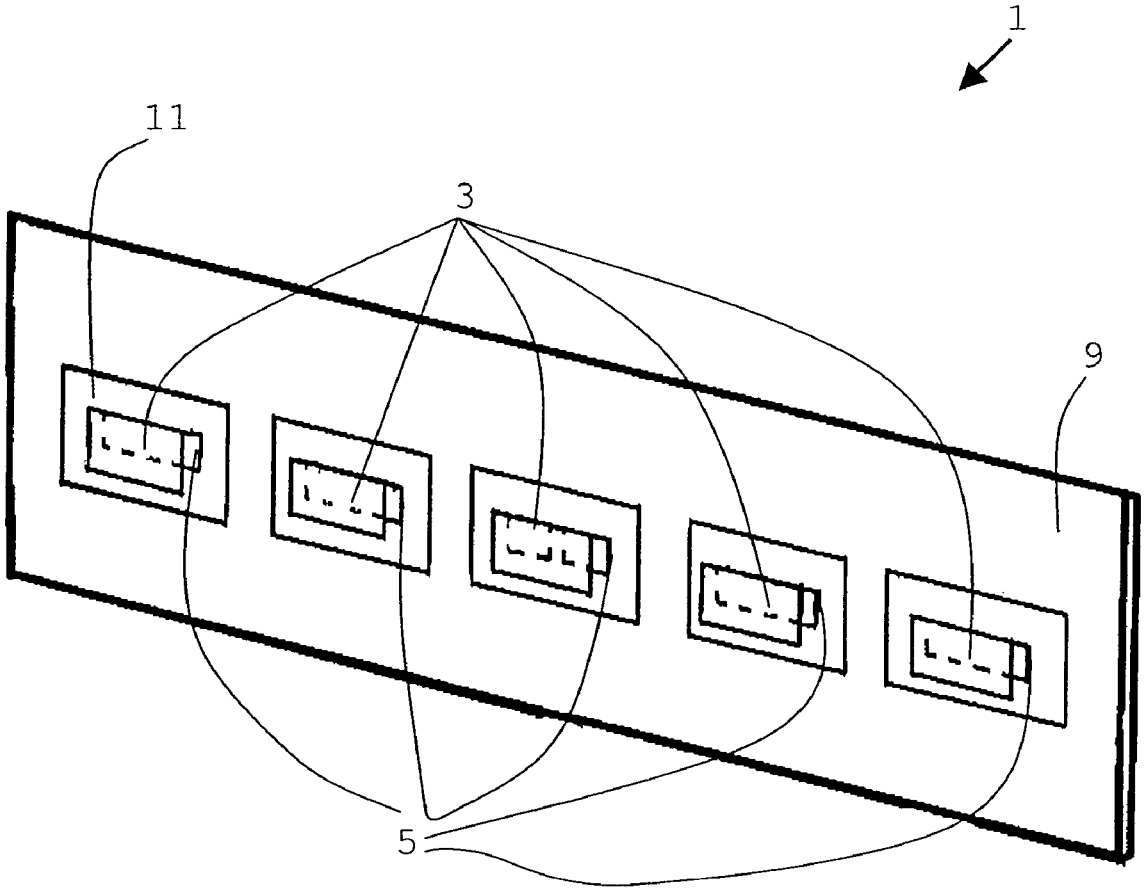
FIG. 11 shows a schematic view of an antenna array having five transmitting and/or receiving devices positioned in series, according to the fourth exemplary embodiment of the present invention.

FIG. 11 shows a schematic view of antenna array 1 according to the present invention, having, for example, five transmitting and/or receiving devices arranged in series, according to a fourth exemplary embodiment. The transmitting and/or receiving devices each include a rectangular patch 3 arranged in front, as well as each a dipole 5 made up of two separate rectangular halves applied onto a substrate layer 11. The supply lines are buried and covered in this view by a metallic earth plane 9 which has recesses only at dipoles 5.

Figure 12:
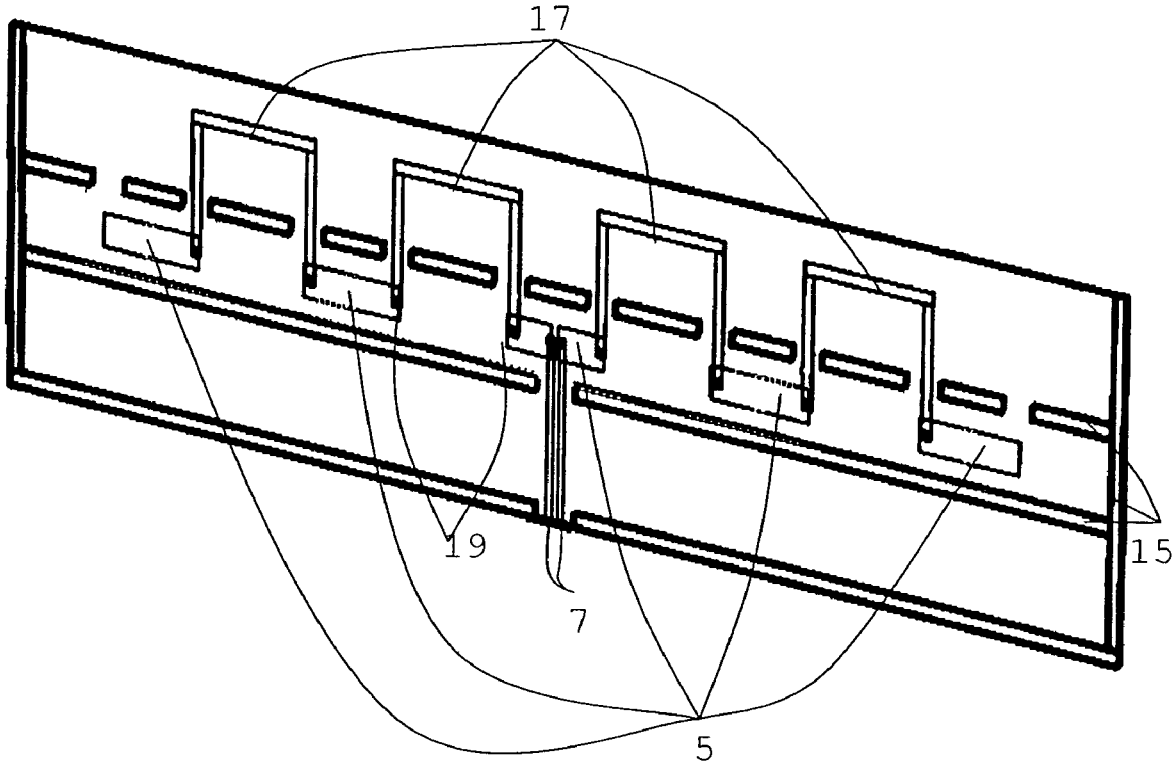
FIG. 12 shows a schematic view of an antenna array beginning at the plane of stratification of the signal supply lines having a representation of the connecting lines according to the fourth exemplary embodiment.

The distance between two adjacent dipoles 5 is approximately one-half wavelength of the transmitted radiation. The layer in which buried signal supply lines 7 run is shown schematically in the view of FIG. 12. Other numerical combinations may be used, and may include an uneven number of elements, at centrical feeding.

According to the exemplary embodiment of the present invention, signal supply lines 7 lead parallel under the respective separate halves of central dipole 5, which are located in the above layer, and are connected to these using vias 19. In each case, from the outer side of one half of central dipole 5, vias 19 lead down to supply lines 17 in the line's plane of stratification, and the latter are led away from the antennas at right angles. These lead, via two additional right-angle bends in the wiring plane, under the outer edge of the respectively adjacent dipole 5, which is located in the layer above it (not shown), and are connected to it (the edge) using vias 19.

Such a conducting supply connection 17 repeats itself in each case to the outer dipoles 5. In this context, the length of the edges of the respective U-shaped supply line 17, which connects adjacent dipoles 5 to one another, amounts to about one-half a wavelength of the transmitted radiation. Due to this construction, the radiation is amplified in the direction of transmission, and the radiation of supply lines 17 perpendicular to this direction is largely suppressed because of mutual canceling out. The metallic chamber strips 15 which have cut-outs only at the breakthroughs of signal supply lines or supply lines 7, 17, form a lateral ground shielding.

Figure 13:
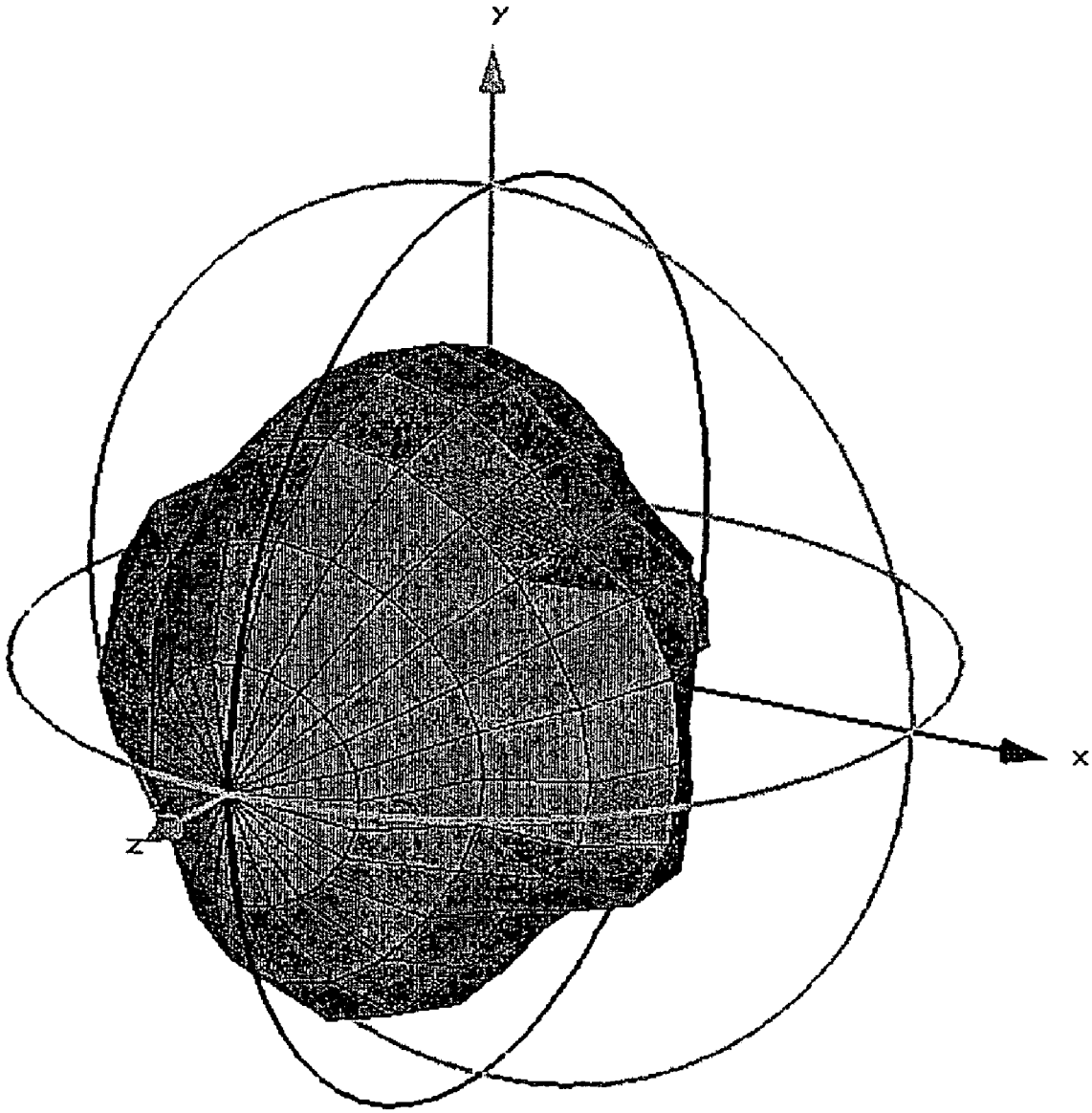
FIG. 13 shows a directional diagram as representation of the directivity characteristic of the far field of the radiation of an antenna array according to the fourth exemplary embodiment.

FIG. 13 shows a directional diagram of the radiation in the far field at a frequency of 28.0 GHz for this fourth exemplary embodiment. The gain is 10.4 dBi. The minor lobes are formed to be very narrow.

Thus, the antenna array according to the exemplary embodiment of the present invention may have a whole field of transmitting and receiving devices. Antennas according to the exemplary embodiment of the present invention may, for example, also be used for a lifting height regulation, in the field of vehicle communications, for tire pressure data transmission or, for instance, for wireless engine data transmission.

Finally, the various features described herein may essentially be freely combined with one another, and not in the sequence presented in the present application, provided they are independent of one another.

What is claimed is:

1. An antenna array, for ascertaining vehicle spacing or vehicle speed in a surrounding of a motor vehicle, comprising:

a layer construction including at least one dielectric layer at least partly including at least one of a transmitter device, a receiver device, and a transmitter-receiver device and a screening layer;

a dipole for the at least one of the transmitter device, the receiver device, and the transmitter-receiver device, the dipole including two separate dipole halves;

a patch arranged parallel to the dipole; and signal supply lines arranged parallel to each other to provide a differential input;

wherein an orientation of the dipole, the patch and the signal supply lines is such that vectors of electrical fields of the patch and the dipole lie parallel and in a same direction, wherein the signal supply lines of the input are integrated into the layer construction, and wherein the signal supply lines are two signal supply lines made up of a parallel array of two printed or etched lines, and in the layer construction, two symmetrically situated dipole halves are provided in a subdivision, which are each conductingly connected to one of the signal supply lines, respectively, the subdivision spatially restricting the radiation.

2. The antenna array of claim 1, further comprising:

a dipole-patch coupling having the patch at a predetermined distance from the dipole.

3. The antenna array of claim 2, wherein a magnitude of the predetermined distance between the patch and the dipole is in the range of 0.1 to 0.2 times a wavelength of a transmitted radiation.

4. The antenna array of claim 2, wherein the dipole is oriented, relative to the signal supply lines, so that the vectors of the electrical fields in the patch and the dipole are in parallel and have the same direction, the dipole and the patch being situated in parallel.

5. The antenna array of claim 2, wherein at least one of the dipole and the patch are shaped on both sides so as to be wedge-shaped, coming to a point towards the middle, in a planar manner.

6. The antenna array of claim 1, wherein there are at least two dielectric layers, and the signal supply lines are buried in one of the dielectric layers of the layer construction.

7. The antenna array of claim 6, wherein the buried signal supply lines are situated between two parallel earth planes.

8. The antenna array of claim 1, wherein the distance between the two signal supply lines assigned to the same dipole are selected to be less than one-tenth of the wavelength of the radiated radiation.

9. The antenna array of claim 1, wherein there are a plurality of transmitting/receiving devices situated at a predetermined distance from one another.

10. An antenna array, for ascertaining vehicle spacing or vehicle speed in a surrounding of a motor vehicle, comprising:

a layer construction including at least one dielectric layer at least partly including at least one of a transmitter device, a receiver device, and a transmitter-receiver device and a screening layer;

a dipole for the at least one of the transmitter device, the receiver device, and the transmitter-receiver device, the dipole including two separate dipole halves;

a patch arranged parallel to the dipole; and signal supply lines arranged parallel to each other to provide a differential input;

wherein an orientation of the dipole, the patch and the signal supply lines is such that vectors of electrical fields of the patch and the dipole lie parallel and in a same direction, wherein the signal supply lines of the input are integrated into the layer construction, wherein there are at least two dielectric layers, and the signal supply lines are buried in one of the dielectric layers of the layer construction, and wherein the signal supply lines are connected in the middle of an inner edge of a respective dipole half.

11. An antenna array, for ascertaining vehicle spacing or vehicle speed in a surrounding of a motor vehicle, comprising:

a layer construction including at least one dielectric layer at least partly including at least one of a transmitter device, a receiver device, and a transmitter-receiver device and a screening layer;

a dipole for the at least one of the transmitter device, the receiver device, and the transmitter-receiver device, the dipole including two separate dipole halves;

a patch arranged parallel to the dipole; and signal supply lines arranged parallel to each other to provide a differential input;

wherein an orientation of the dipole, the patch and the signal supply lines is such that vectors of electrical fields of the patch and the dipole lie parallel and in a same direction, wherein the signal supply lines of the input are integrated into the layer construction, wherein there are at least two dielectric layers, and the signal supply lines are buried in one of the dielectric layers of the layer construction, and the buried signal supply lines are situated between two parallel earth planes wherein a ground bordering, which shields perpendicular to the stratification, between the two parallel earth planes, at least partially surrounds the dipole.

12. The antenna array of claim 11, wherein the ground bordering has a distance from the dipole of approximately one-quarter of the wavelength.

* * * * *